United States Patent [19]

Zückler

[11] 4,225,762

[45] Sep. 30, 1980

[54] GAS BLAST CIRCUIT BREAKER

[75] Inventor: Karl Zückler, Berlin, Fed. Rep. of Germany

[73] Assignee: Siemens Aktiengesellschaft, Munich, Fed. Rep. of Germany

[21] Appl. No.: 970,214

[22] Filed: Dec. 18, 1978

[30] Foreign Application Priority Data

Dec. 30, 1977 [DE] Fed. Rep. of Germany ..... 2759267

[51] Int. Cl.[2] ..... H01H 9/30

[52] U.S. Cl. ..... 200/144 R; 200/147 A; 200/148 A

[58] Field of Search ..... 200/148 R, 148 A, 148 B, 200/148 C, 148 D, 148 E, 148 F, 148 G, 148 H, 148 J, 148 BV, 147 R, 147 A, 147 B, 150 G, 144 R

[56] References Cited

U.S. PATENT DOCUMENTS 2,280,321 4/1942 Thommen ..... 200/148 R 3,014,107 12/1961 Cobine et al. ..... 200/148 R X 3,985,988 10/1976 Korner et al. ..... 200/148 A X

*Primary Examiner*—J. V. Truhe

*Assistant Examiner*—Morris Ginsburg

*Attorney, Agent, or Firm*—Kenyon & Kenyon

[57] ABSTRACT

A gas blast circuit breaker having a movable contact, a mating contact and a nozzle aperture through which the movable contact can travel; the nozzle aperture is disposed in a wall dividing the switching chamber and the wall supports an arc during switching-off. The mating contact is arranged on a piston which is spring loaded in the opening direction and follows the movable contact at the beginning of the latter's switching-off motion. In the process, the gas located between the end faces of the piston and the mating contact facing the movable contact and the wall dividing the switching chamber is compressed until the contacts are separated, when the gas flow, under pressure, serves to cool the arc.

6 Claims, 2 Drawing Figures

GAS BLAST CIRCUIT BREAKER

BACKGROUND OF THE INVENTION a. Field of the Invention

This invention relates to a gas blast circuit breaker having a movable contact, a mating contact and a nozzle aperture through which the movable contact can travel. More particularly, the nozzle aperture is disposed in a wall dividing the switching chamber which generates a quenching gas flow initiated by the arc.

b. Description of the Prior Art

A gas blast circuit breaker of this type is described in the German Offenlegungsschrift No. 23 49 246. In it, the quenching gas flow is set in motion by an auxiliary arc drawn in the course of the interrupting action which blasts the arc drawn between the movable contact and the mating contact. In this structure the quenching gas flow is dependent on the current to be interrupted or the current flowing in the arc.

In some cases it is desirable to set in motion an additional flow of quenching gas which is independent of the current as soon as an "off" command is given.

It is an object of this invention to provide a gas blast circuit breaker of this type, in which, in addition to the generation of a quenching gas flow dependent on the current, a quenching gas flow, independent of the current, is supplied.

SUMMARY OF THE INVENTION

According to the invention, this problem is solved by arranging the mating contact on a piston which is spring loaded in the opening direction and which follows the movable contact at the beginning of the latter's interrupting motion. The gas located between the end face of the piston pointing toward the movable contact and the wall is compressed, in the process.

In the circuit breaker of German Offenlegungsschrift No. 23 49 246, above, the mating contact is mounted on a spring loaded support which causes the mating contact to follow the movable contact travelling in the "off" direction for a certain distance, the support is not designed as a piston which causes pre-compression of the gas.

Through the application of the invention, it is possible to reliably interrupt currents substantially larger.

In another feature of the invention, the mating contact is surrounded by a first coil which carries the current to be interrupted after the metallic separation of the movable contact and to which a further coil is connected in an opposing sense, the latter coil being carried along with the movable contact and also carrying the current to be interrupted.

German Offenlegungsschrift No. 24 23 103 describes a circuit breaker having a coil which surrounds the mating contact and which carries the current to be interrupted after the contacts are metallically separated; it produces a magnetic field which acts on the arc. The magnetic blasting effect produced thereby leads to improved quenching conditions.

The structure of this invention differs from that just mentioned by the addition of another coil which is driven along with the movable contact and also carries the current to be interrupted; it is connected to the first coil in an opposing sense. The resulting magnetic field is particularly advantageous in that quenching conditions and, thereby, interruption conditions for large currents are more favorable.

In one embodiment, the first coil consists of a helically cut, hollow cylinder of electrically conductive material which is rigidly connected to the piston. The second coil is preferably a helically cut, hollow cylindrical part of the movable contact, in the interior of which a ferromagnetic body may be disposed. In this embodiment, the end faces of the coils carry burn-off electrodes to provide wear resistance under arc stresses.

DETAILED DESCRIPTION OF THE INVENTION

Figure 1:
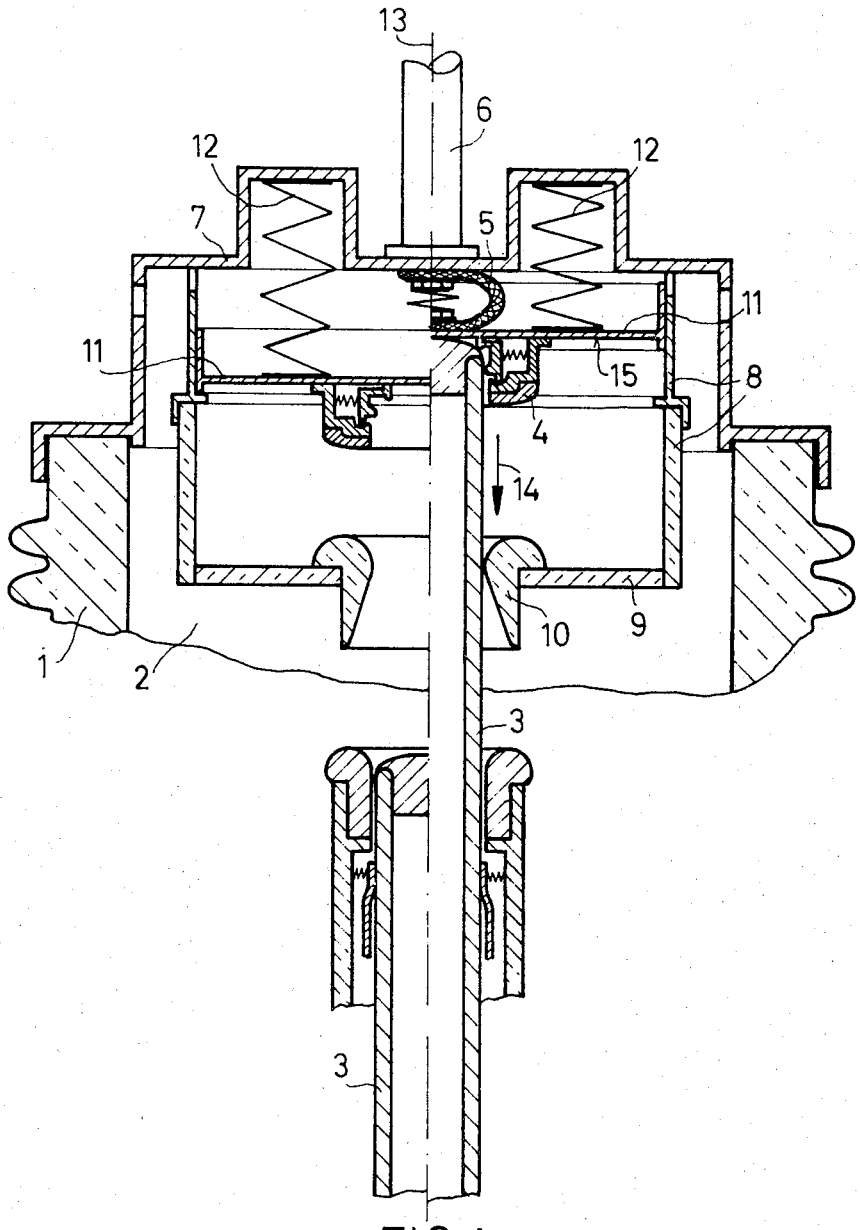
FIG. 1 is a view in split cross-section of a gas blast circuit breaker embodying the teachings of the invention; the left side shows the breaker after opening.

The gas blast circuit breaker shown in FIG. 1 comprises a hollow, insulating cylindrical switching member 1, which may, for example, be made of porcelain, and the switching chamber 2 of which is filled with sulfur hexafluoride as the gaseous quenching and insulating medium. A movable contact 3 is centered in the interior and cooperates with a mating contact 4, being received therein. Mating contact 4 is connected electrically to a terminal 6 via a current carrying ribbon 5. The terminal 6 is mounted on a cap 7 which closes the switching chamber 2 at the end face of cylinder 1. The cap 7 has a tubular inner support 8 extending into the switching chamber 2 and consists, in its lower part at least, of insulating material. At its lower end, inner support 8 carries a wall 9 which divides the switching chamber 2 into two parts. The wall 9, in turn, supports a nozzle 10 which surrounds the movable contact when it is in the "on" position.

The upper part of support 8 is cylindrical in shape and guides piston 11 for motion towards and away from wall 9. The piston 11 is loaded in the direction of interruption by springs 12 which are braced against the cap 7. Piston 11 carries the mating contact 4, which occupies the position shown (FIG. 1) to the right of center line 13 in the "on" position and the position shown to the left of center line 13 in the "off" position.

If movable contact 3 is moved in the direction of the arrow 14 into the "off" position due to an "off" command, then the mating contact 4 and the spring loaded piston 11 follow the movable contact 3 a certain distance, but not so far as to close the space between wall 9 and piston 11. In this process, the gas located between the end face 15 of piston 11 and the wall 9 undergoes compression, or is "precompressed" until the metallic separation between the contacts 3 and 4 takes place. Then the arc drawn in the separation process is supplied with, and cooled by, the compressed gas. In the course of the opening motion, the contact 3 is pulled further down until it leaves the nozzle 10. Then the arc burning in the space between the piston 11 and the wall 9 sets in motion a flow of quenching gas through the nozzle 10 due to the increase in pressure caused by the burning arc.

Figure 2:
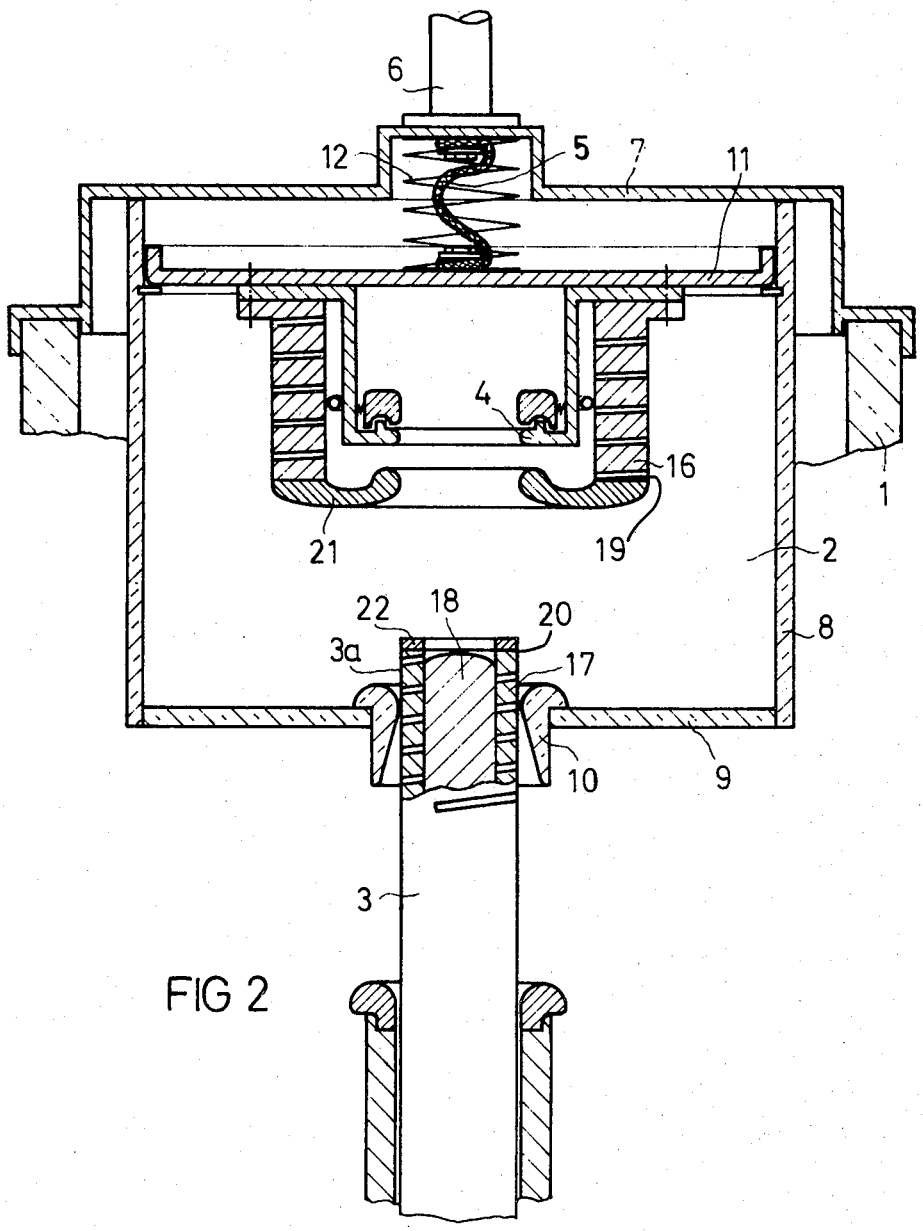
FIG. 2 is a view in cross-section of another embodiment of a gas blast circuit breaker according to the teachings of the invention.

Reference is now made to FIG. 2 in which parts like those in FIG. 1 are provided with the same reference symbols. Here, the mating contact 4 is surrounded by a coil 16 through which current flows after the movable contact 3 is metallically separated from the mating contact 4, and which thus provides a magnetic field for additional blasting of the arc. The movable contact 3 is cut in the area of its free end *3a*, taking the form of a cylindrical helix; it thus forms a second coil through which the current to be interrupted, i.e., the arc current, flows. This second coil 17 is wound, e.g. configured, so that it generates a magnetic field opposing that of the first coil 16.

As is apparent from the drawing, the first coil 16 consists of a helically cut hollow cylinder of electrically conductive material which is rigidly connected to the piston 11. The coil 17 is a helically cut hollow cylindrical part on the movable contact 3. A ferromagnetic body 18 is arranged in the interior of the hollow part 17 of the movable contact 3 and contributes to reinforcement of the magnetic field. The end faces 19 and 20 of the coils 16, 17 carry burn-off electrodes 21 and 22 which ensure high wear resistance under arc stresses.

This embodiment of the gas blast circuit breaker is particularly well suited for high interruption voltages and for small driving force. It has the advantages of gas blast circuit breakers with quenching gas flow which is current dependent and current independent.

What is claimed is:

1. In a gas blast circuit breaker having a movable contact disposed in a switching chamber filled with gas and a spring biased mating contact which follows the movable contact at the onset of a switching-off motion thereof, the switching chamber being divided by a stationary wall having a middle opening which is penetrated by the movable contact and the switching chamber containing a movable wall which, in moving, follows the switching-off motion and compresses the gas which is between the movable and the stationary wall, the improvement in which the movable wall comprises a piston which is spring-loaded in the direction of the switching-off motion, carries the mating contact, and comprises an end face of the switching chamber.

2. A gas blast circuit breaker in accordance with claim 1, further comprising the feature that the mating contact is surrounded by a first coil which carries the current to be interrupted after metallic separation of the mating contact from the movable contact, and the movable contact is connected to a second coil which moves with the movable contact and carries the current to be interrupted.

3. A gas blast circuit breaker in accordance with claim 2, in which the first coil is a helically cut hollow cylinder of electrically conductive material which is rigidly connected to the piston.

4. A gas blast circuit in accordance with claim 3 in which the second coil is helically cut hollow cylindrical part of the movable contact.

5. A gas blast circuit breaker in accordance with claim 4 in which a ferromagnetic body is disposed in the interior of the hollow cylindrical part of the movable contact.

6. A gas blast circuit breaker in accordance with one of the claims 2, 3, 4, or 5, in which the coils have end faces which carry burn-off electrodes.

* * * * *